US005945181A

United States Patent [19]

Fisher

[11] Patent Number: 5,945,181

[45] Date of Patent: Aug. 31, 1999

[54] TESSELLATABLE ELEMENTS AND PLANE TESSELLATIONS FOR COVERING OR DECORATION

[76] Inventor: Adrian Fisher, 5 Victoria Grove, Southsea, Hampshire, PO5 1NE, United Kingdom

[21] Appl. No.: 08/730,545

[22] Filed: Oct. 11, 1996

[51] Int. Cl.[6] ..... B44F 11/04

[52] U.S. Cl. ..... 428/33; 52/311.2; 428/49

[58] Field of Search ..... 428/15, 33, 49; 52/311.2; 273/153 R

[56] References Cited

U.S. PATENT DOCUMENTS

| | | | |
|---|---|---|---|
| 4,350,341 | 9/1982 | Wallace | 428/47 X |
| 4,550,040 | 10/1985 | Fisher | 428/33 |
| 5,194,969 | 3/1993 | Di Francisco | 428/49 X |
| 5,348,417 | 9/1994 | Scheiwiller | 404/41 |
| 5,520,388 | 5/1996 | Osborn | 428/49 X |
| 5,560,173 | 10/1996 | Scheiwiller | 52/608 |

FOREIGN PATENT DOCUMENTS

A-0487807 6/1992 European Pat. Off. .

*Primary Examiner*—Henry F. Epstein

*Attorney, Agent, or Firm*—Cowan, Liebowitz & Latman, P.C.

[57] ABSTRACT

Sets of tessellatable polygonal elements are provided from which a variety of tessellations may be formed for a variety of applications, e.g., to provide coverings and decorations for surfaces such as pedestrian walks, driveways, floors and walls, and to provide patterns for games, puzzles and coloring books. Several different embodiments, applications and tessellations are described. In one embodiment, irregular heptagonal elements are tessellated with substantially regular pentagonal elements. In another embodiment, the elements are heptagonal and square. The tessellations may have straight edges by providing one or more elements of the set of tessellatable elements with a line of symmetry and providing a further tessellatable element or elements which is that part of the element on either side of the line of symmetry. The elements may be colored to provide many variations and decorations. The tessellatable elements described herein may also tessellate with standard size elements of the same or compatible type element.

42 Claims, 18 Drawing Sheets

TESSELLATABLE ELEMENTS AND PLANE TESSELLATIONS FOR COVERING OR DECORATION

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND OF THE INVENTION

This invention relates to tessellatable elements and to plane tessellations made from such elements. The tessellatable elements may be paving stones or blocks, bricks, tiles, decorative covering elements, playing cards, game pieces, etc., and the tessellations may form coverings and pavings of various kinds for various purposes including pedestrian walks, driveways, streets, floors, walls, decorations, games, puzzles, mazes, mosaics, patterns on fabrics and within computer software games, computer simulation, computer displays, etc.

It is usual to cover or decorate surfaces such as walls and floors with elements such as bricks, paving stones and tiles. For aesthetic reasons, and for uniformity, surface coverings and decorations often comprise a tessellation of elements. A tessellation is an arrangement of polygons without gaps or overlapping, usually in a repeated pattern. For example, in pedestrian malls and crossings it is common to have walkways made of a repeated pattern of rectangular paving stones. A 'herring-bone' pattern made of identically-sized rectangular paving stones is popular for this purpose.

In practice, it is usually sufficient with paving stones for example to combine shapes that approximately tessellate, since any gaps may be filled by, e.g., mortar or sand.

Sometimes surface coverings and decorations have mosaics incorporated therein. To form a picture or pattern from a mosaic of rectangular elements often involves the reshaping of elements by cutting, particularly if the picture or pattern includes curves or bends. It will be appreciated that the cutting of paving stones, for example, is both physically strenuous and time consuming and can involve considerable wastage of material.

It is also well known to use tessellations for patterns in children's' coloring books and for jig-saw and puzzle games.

SUMMARY OF THE INVENTION

It is an object of the invention disclosed herein to provide tessellatable elements in sets of as few as two from which a variety of tessellations may be formed for a variety of applications.

It is another object of the invention to provide tessellatable elements from which tessellations with straight edges may be made with little or no cutting, or by cutting one of the elements substantially in half, or otherwise providing an element which is substantially half of another element.

It is another object of the invention to provide sets of tessellatable elements of polygonal shapes not typically used which may be used with regular or standard elements of the same or a compatible type of element, and/or which may be used with other elements, that meet the tessellatable elements along a straight edge or edges formed by a tessellation of the tessellatable elements.

According to the present invention a set of tessellatable elements is provided which may comprise only two different polygonal elements that differ in the number of sides that each has, with at least one of the elements having an odd number of sides and no internal angle of 90°, and preferably no internal acute angle.

In specific embodiments, at least one of the two polygonal elements in a set has either equal sides or equal internal angles, or both and preferably is a substantially regular polygonal element. The sets of tessellatable elements may comprise irregular heptagonal elements and substantially regular pentagonal elements or square elements. In the preferred embodiments, one of the two polygonal elements is a heptagonal element and the other a pentagonal element or a square element. In these embodiments, the pentagonal element and the square element are the substantially regular polygonal elements.

According to the present invention there is further provided a plane tessellation comprising a repeated pattern of sets of the tessellatable elements with the edges of the elements substantially abutting.

At least one of the polygonal elements other than the square element is preferably symmetrical about a line or axis, and a third tessellatable polygonal element is provided formed by that part of the polygon lying on either side of the line of symmetry, which when used with two other tessellatable elements in a set enables the formation of a tessellation with one or more straight sides.

In one embodiment, providing a third tessellatable element from one element of the set of polygonal elements enables the formation of tessellations with straight edges on all sides. In this embodiment, a set with the third tessellatable element enables the formation of square tessellations, or tessellations made from sets of square tessellation sections.

In other embodiments, more than one third tessellatable element may be necessary to form tessellations with all straight edges, and such third tessellatable elements may be obtained by cutting another tessellatable element of the set, which may not have a line of symmetry, of generally the same size. In some embodiments, some additional cutting may be required at the vertices of the tessellation.

The sets of tessellatable elements maybe combined with regular tessellatable elements, and/or they may allow other elements to abut a tessellation of the tessellatable elements along a straight line or straight lines that intersect at right angles.

The tessellatable elements may be the things mentioned above and other things mentioned herein or apparent to those of skill in the art. Tessellations made in accordance with the invention are suitable for many applications as mentioned above and others mentioned herein or apparent to those of skill in the art.

BRIEF DESCRIPTION OF THE DRAWINGS

Preferred embodiments of the present invention are be described below by way of example only, with reference to the accompanying drawings, in which like reference numbers in different figures refer to like or corresponding parts, and in which:

FIGS. 15*a*–15*c* show three tessellatable elements forming a set, in which FIG. 15*a* shows an irregular heptagonal element having a line of symmetry therethrough, FIG. 15*b* shows a pentagonal element which is half the heptagonal element along the line of symmetry, and FIG. 15*c* shows a square element;

In the figures the shading hatching, stippling and the like represent color to illustrate the many different patterns possible

DESCRIPTION OF THE PREFERRED EMBODIMENTS

FIGS. 1*a* to 1*g* show various tessellations 1 according to the present invention which utilize two types of polygons, namely, a regular pentagonal element 2 and an irregular heptagonal element 3, 4 or 5. Heptagonal elements 3, 4 and 5 are described in more detail below.

Figure 1A:
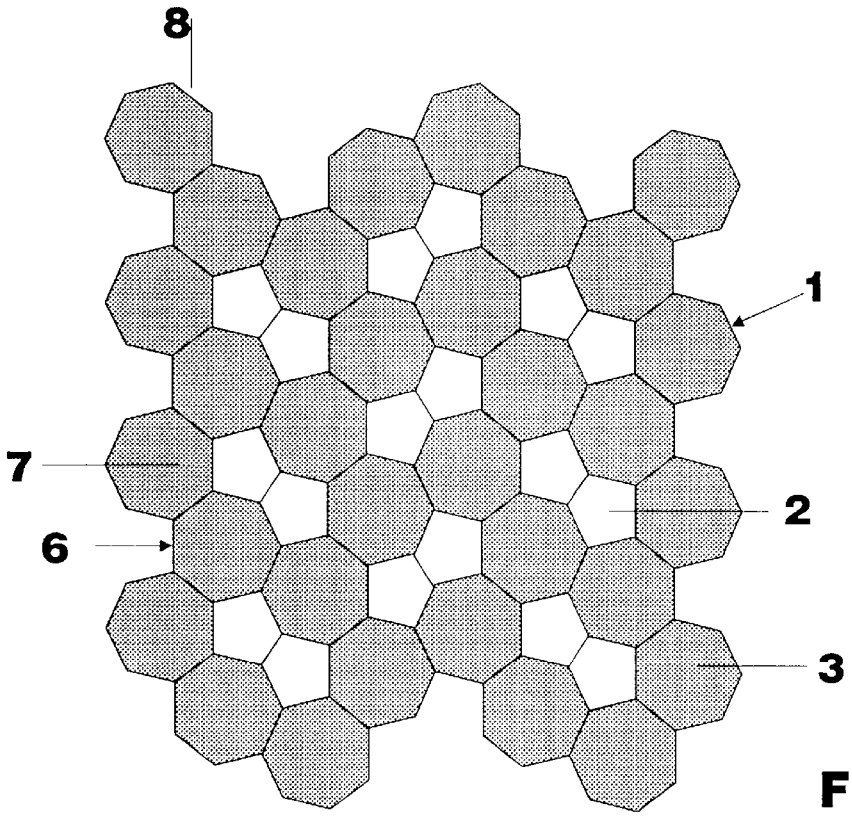
FIGS. 1*a* to 1*g* show various tessellations according to the present invention made from a regular pentagonal element and an irregular heptagonal element.
Figure 1B:
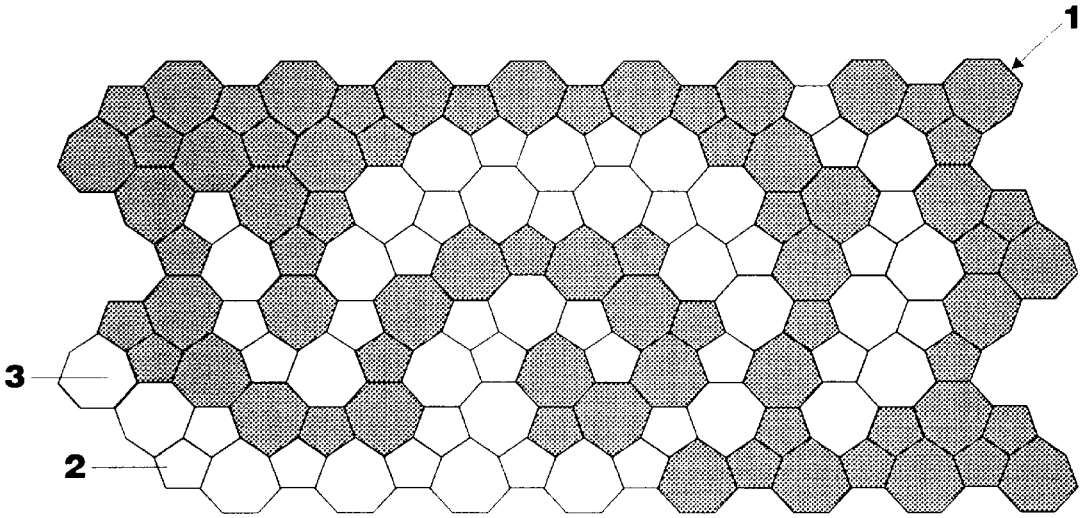
Figure 1C:
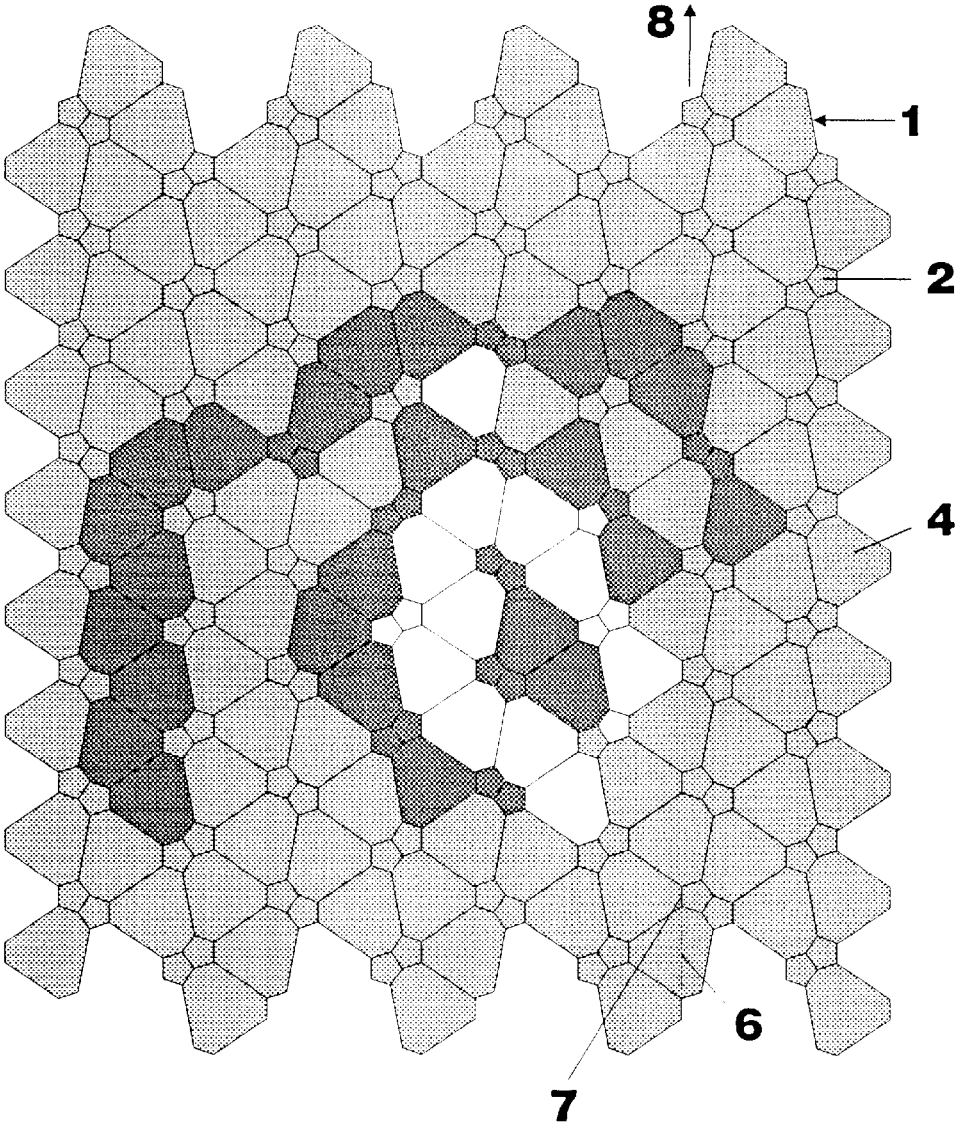
Figure 1D:
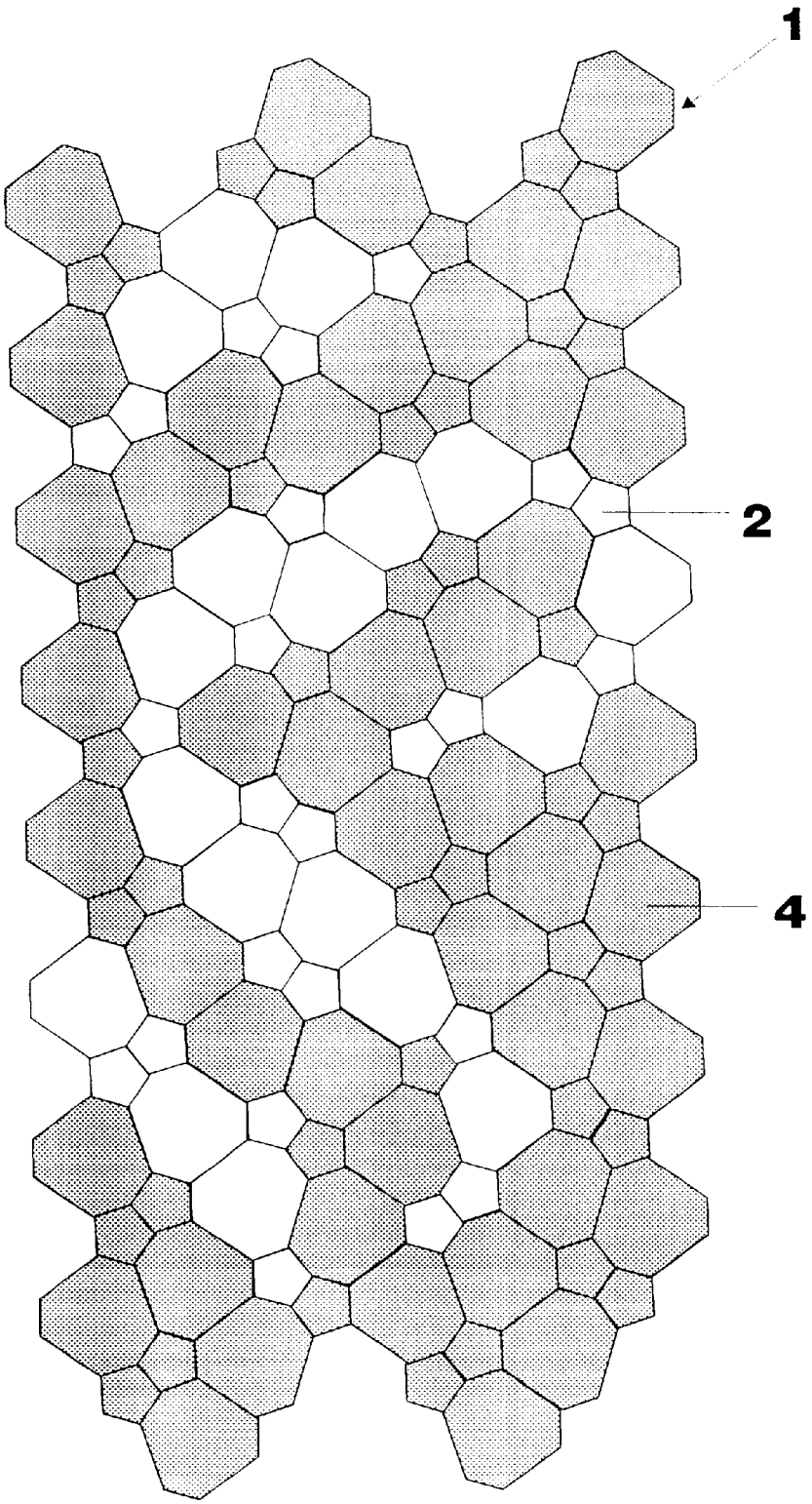
Figure 1E:
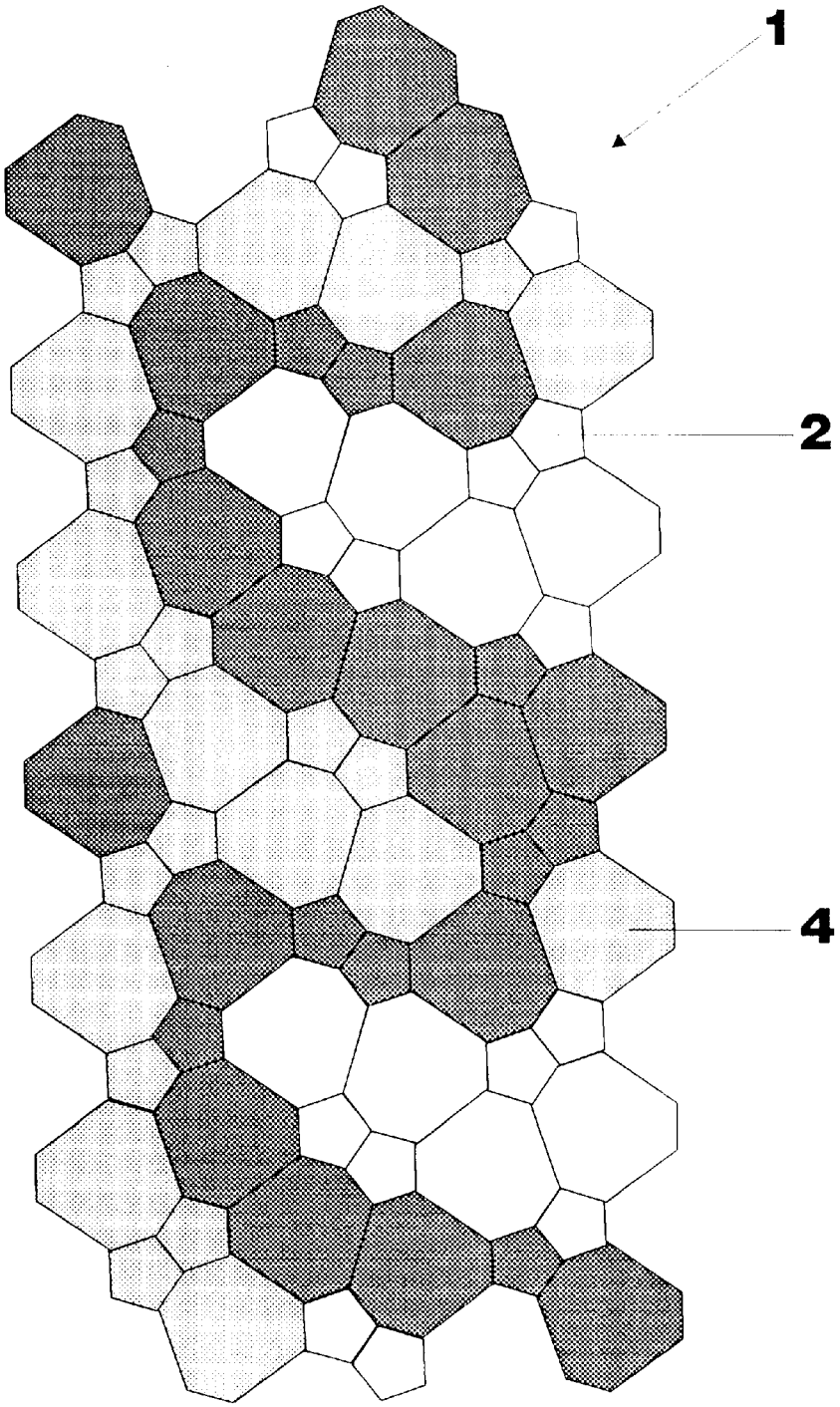
Figure 1F:
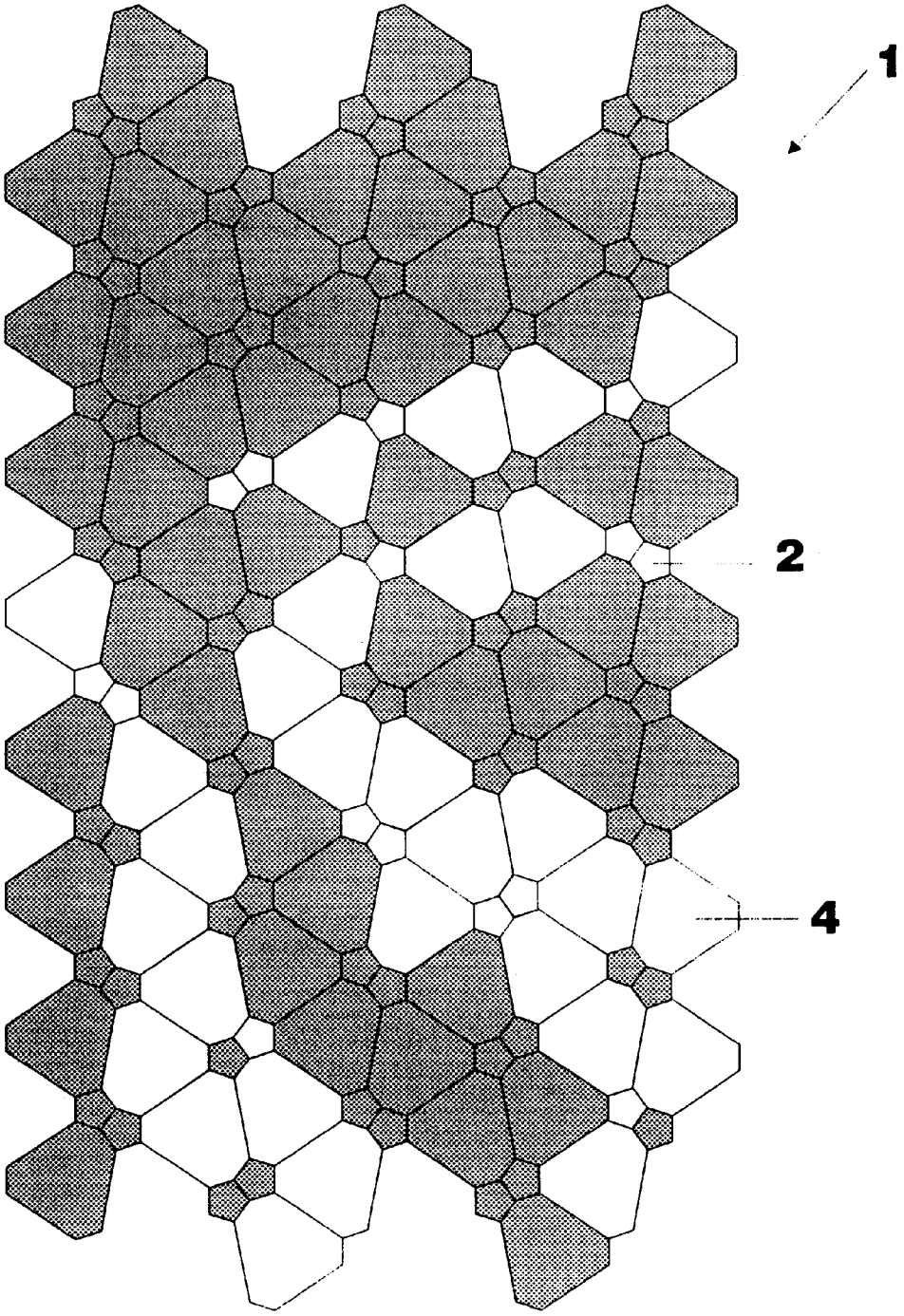
Figure 1G:
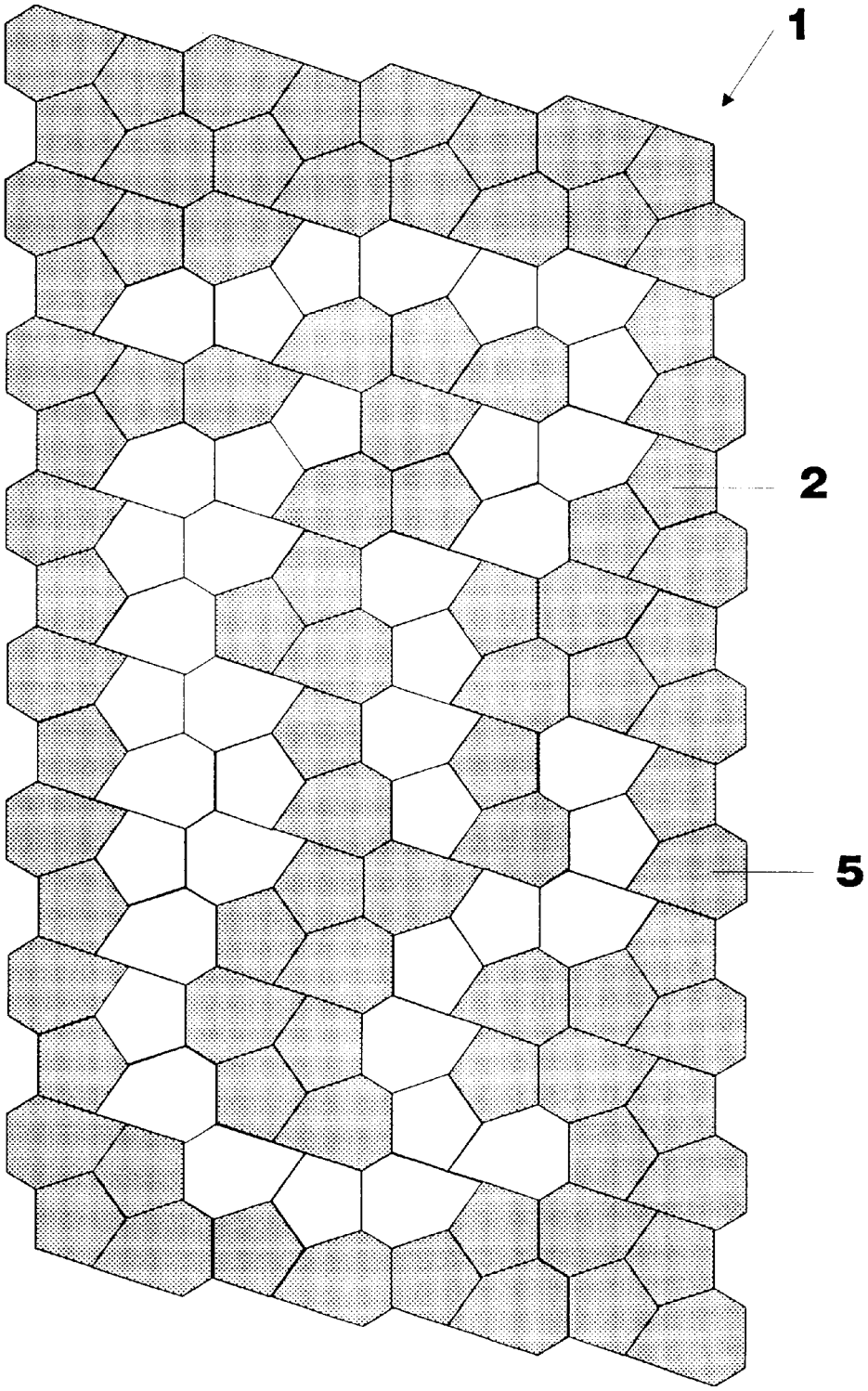
Figure 2A:
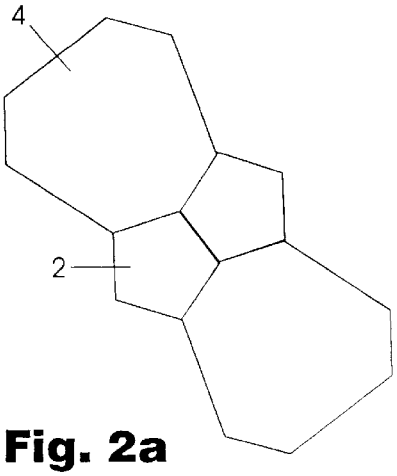
FIGS. 2*a* to 2*c* show 'napkin and ring' blocks for building tessellations from a regular pentagonal element and an irregular heptagonal element.
Figure 2B:
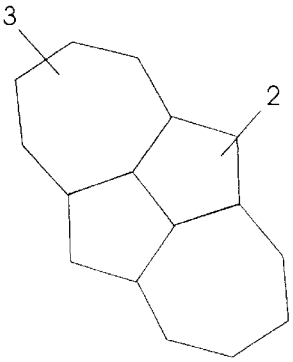
Figure 2C:
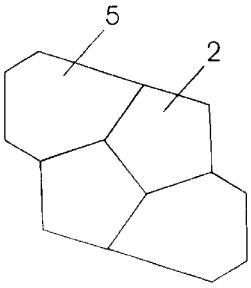
Figure 3A:
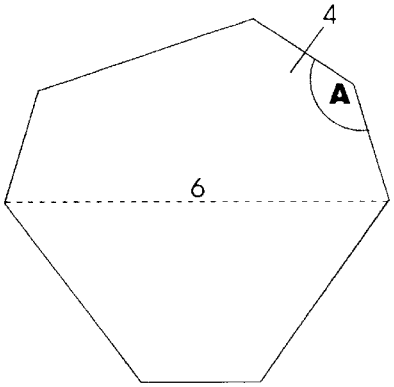
FIGS. 3*a* and 3*b* show two irregular heptagonal elements.
Figure 3B:
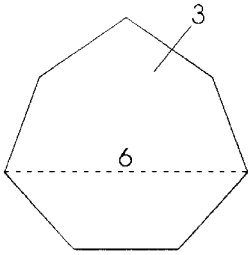
Figure 3C:
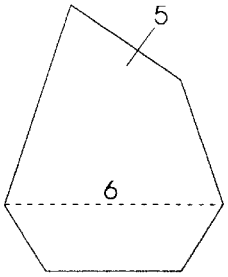
FIG. 3*c* shows a pseudo-heptagonal element and FIG. 3*d* shows a regular pentagonal element.
Figure 3D:
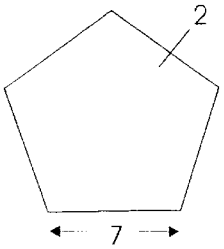

A building block for each tessellation in some embodiments comprises two pentagonal elements and two heptagonal elements in a 'napkin and ring' configuration, as shown in FIGS. 2*a* to 2*c* in which the pentagonal elements 2 form the 'ring' and the heptagonal elements 3, 4 or 5 form the 'napkin'. Typically, these building blocks are arranged sideways such that they tilt one way along one row, and then the opposite way along the next row, thus forming alternate 'left-hand' and 'right-hand' bands, as demonstrated in the tessellations shown in FIGS. 1*a* to 1*g*. Alternatively, in some applications, adjacent rows may tilt in the same direction to achieve a certain design objective. In card games, for example, such a 'deviant' configuration could be used for tactical advantage.

Preferably, the heptagonal element and the pentagonal element do not have the same surface area. This allows greater design flexibility and provides a more rigorous and visually interesting tessellation. Further, the two elements can be readily distinguished by their size, thus reducing errors during the stockholding and supply of the elements, the construction of the tessellation or when playing the elements as a card game, for example.

Normally the pentagonal element is smaller in surface area than the heptagonal element since this helps to reduce errors when laying large numbers of elements to form a tessellation.

The size of the irregular heptagonal element used in the tessellation, relative to the size of the regular pentagonal element used, can be determined by the length of the heptagonal element's 'long diagonal'. The 'long diagonal' is the longest distance between non-adjacent vertices of the heptagonal element which is parallel to the direction of the row and thus also parallel to one of the sides of the regular pentagonal element tessellated therewith. FIG. 3 shows heptagonal elements 3, 4 and 5 with their 'long diagonal' 6 shown in broken lines. Heptagonal element 5 is, in fact, six-sided since two of its sides form a straight line; it is therefore described as a pseudo-heptagonal element for the purposes of this invention.

To be able to form a useful plane tessellation, the ratio of the length of a side 7 of the pentagonal element to the length of the long diagonal 6 of the heptagonal element should range between 1:1.5 (i.e. 16:24) and 1:6.0 (16:96). Heptagonal element 4 has a ratio of 1:3.2360879 (~16:52), heptagonal element 3 has a ratio of 1:2.2360879 (~16:36), and pseudo-heptagonal element 5 has a ratio of 1:1.618034 (~16:26). Other suitable ratios are 16:28, 16:32, 16:48, 16:60 and 16:72, for example.

In FIGS. 1*a*, 1*c* and 1*g*, a pentagonal element 2 is tessellated with heptagonal elements 3 to 5 respectively. In these Figures, the long diagonal 6 of the heptagonal element is marked, together with the side 7 of the regular pentagonal element to which it is parallel, and the direction 8 of the row.

Heptagonal element 3 is a particularly useful polygon since it is symmetrical about its vertical axis. Heptagonal element 4 is also very useful since it is symmetrical about the axis that bisects its largest interior angle A of 144°.

Figure 4:
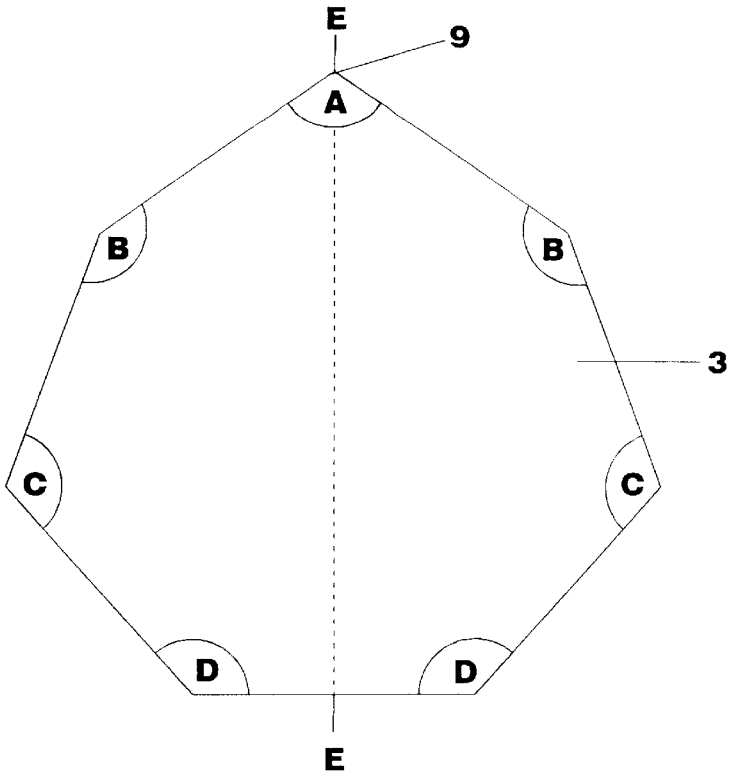
FIG. 4 shows a plan view of an irregular heptagonal element having a line of symmetry therethrough.

FIG. 4 shows heptagonal element 3 in more detail. This heptagonal element has one interior angle A of 108°, two interior angles B of 144°, two interior angles C of 123.826° and two interior angles D of 128.174°. As mentioned above, the heptagonal element has axial symmetry about line E—E which passes through its leading vertex 9. The seven sides of the heptagonal element are equal in length.

Figure 5:
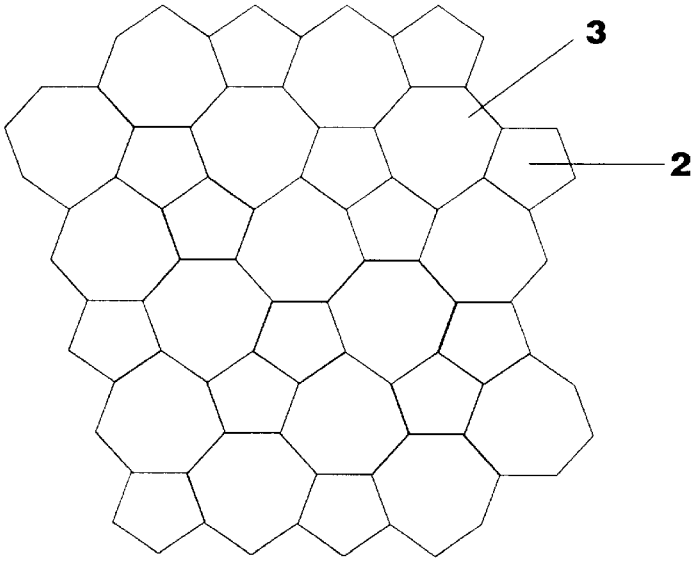
FIG. 5 shows a tessellation including the irregular heptagonal element of FIG. 4

Heptagonal element 3 tessellates with the regular pentagonal element 2, as shown in FIG. 5. The pentagonal element 2 has sides which are equal in length to the sides of heptagonal element 3.

Figure 6:
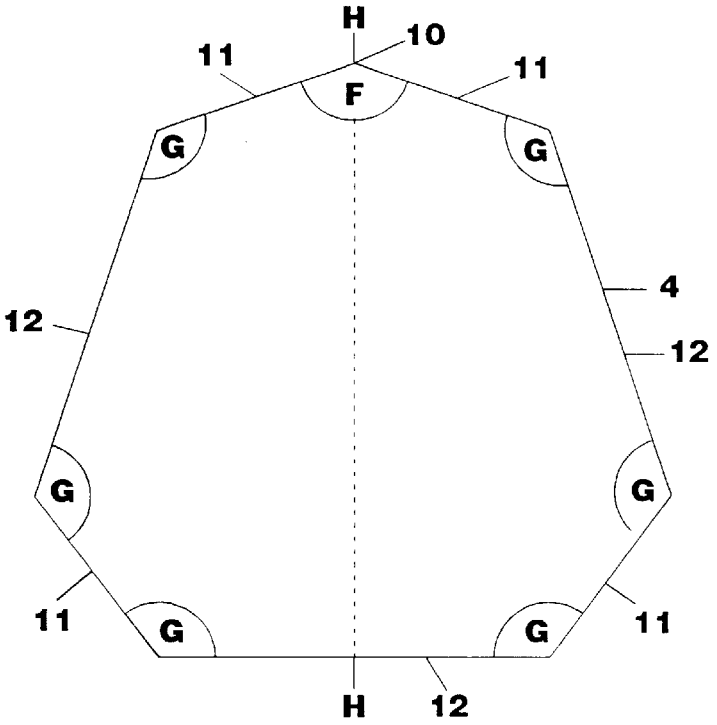
FIG. 6 shows a plan view of an alternative heptagonal element having a line of symmetry therethrough.

FIG. 6 shows in more detail heptagonal element 4. This heptagonal element has one interior angle F of 144° and six interior angles G of 126°. As mentioned above, the heptagonal element has axial symmetry about line H—H which passes through its leading vertex 10. Four sides 11 of the heptagonal element are equal in length and three sides 12 of the heptagonal element are equal in length. The length of each side 12 is 1.90213 times as long as the length of each side 11.

Figure 7:
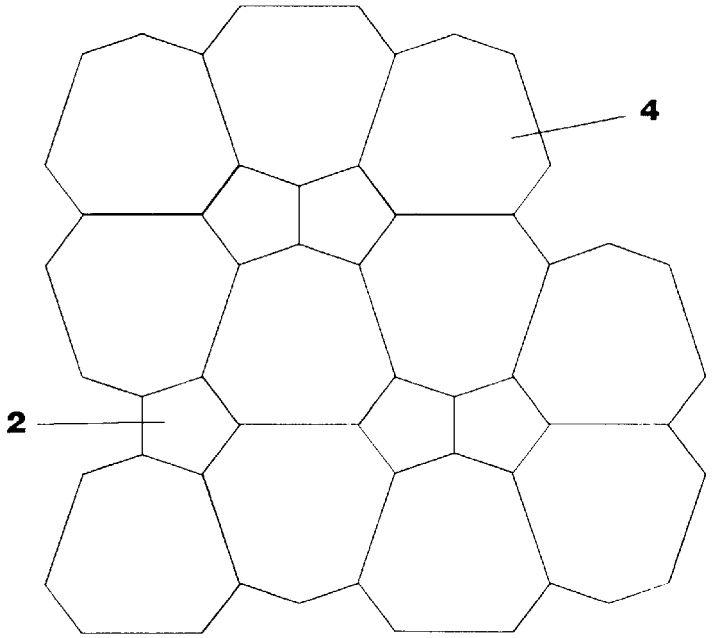
FIG. 7 shows a tessellation including the irregular heptagonal element of FIG. 6.

Heptagonal element 4 tessellates with the regular pentagonal element 2, as shown in FIG. 7. The pentagonal element has sides which are equal in length to sides 11 of heptagonal element 4.

Figure 8:
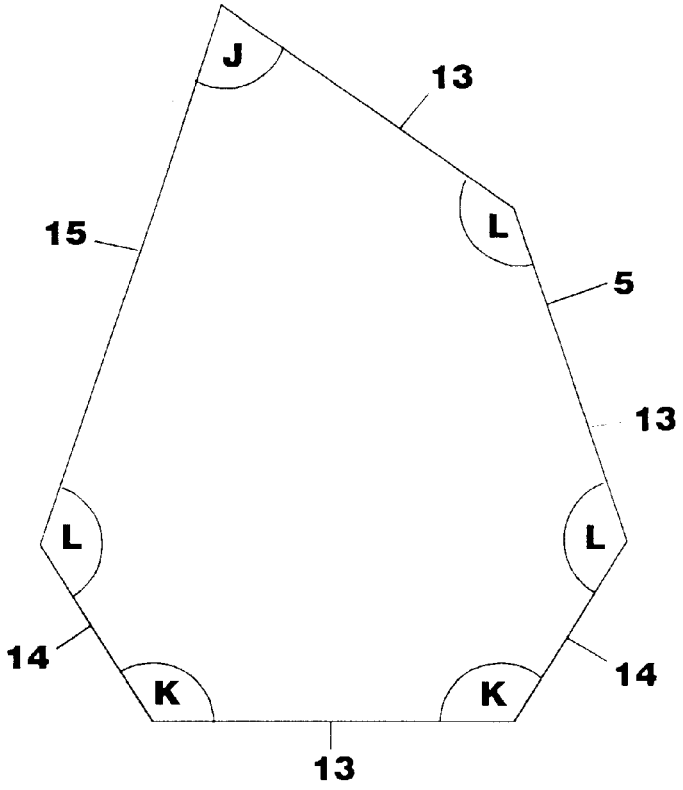
FIG. 8 shows a plan view of a pseudo-heptagonal element.

Pseudo-heptagonal element 5 is shown in more detail in FIG. 8. This polygon has one interior angle J of 72°, two interior angles K of 108°, and three interior angles L of 144°. Three sides 13 of the polygon are equal in length and two sides 14 are equal in length. The length of each side 14 is 0.618034 times as long as the length of each side 13. Side 15 is 1.618034 times as long as side 13 since it is, in effect, a side 14 which is contiguous and parallel to a side 13 (i.e. a side 14 and a side 13 form a straight line).

Figure 9:
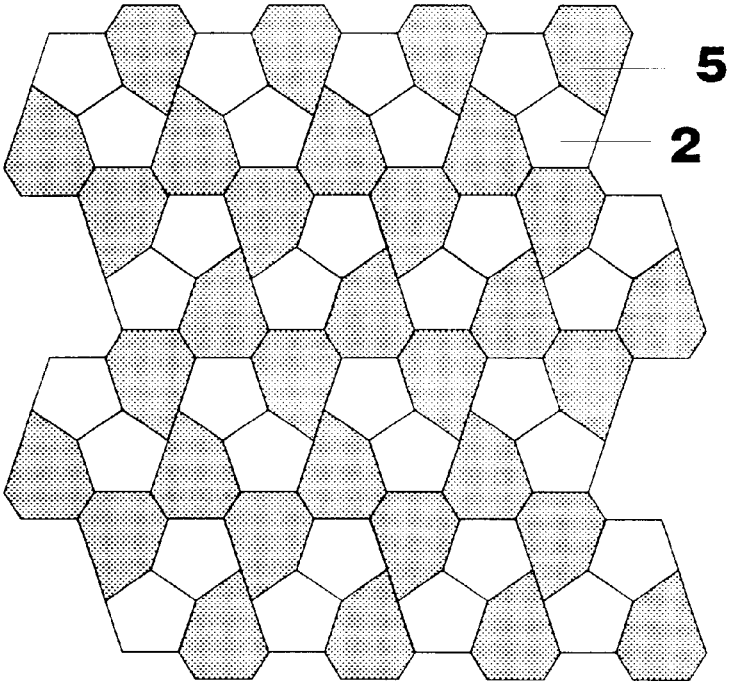
FIG. 9 shows a tessellation including the pseudo-heptagonal element of FIG. 8.

Pseudo-heptagonal element 5 tessellates with the regular pentagon 2, as shown in FIG. 9. The pentagonal element has sides which are equal in length to sides 13 of pseudo-heptagonal element 5.

In practice, heptagonal elements 3, 4 and 5 may have interior angles which are approximately equal to those detailed above and still be able to tessellate, to a substantial degree, with a regular pentagonal element. Further, the pentagonal element may be only approximately regular. Also, the length of the sides of the heptagonal elements, and the length of the sides of the pentagonal element, may only approximately correspond to those lengths detailed above, such that the sides of the pentagonal element may only be approximately equal in length to the corresponding sides of the heptagonal element.

Figure 10:
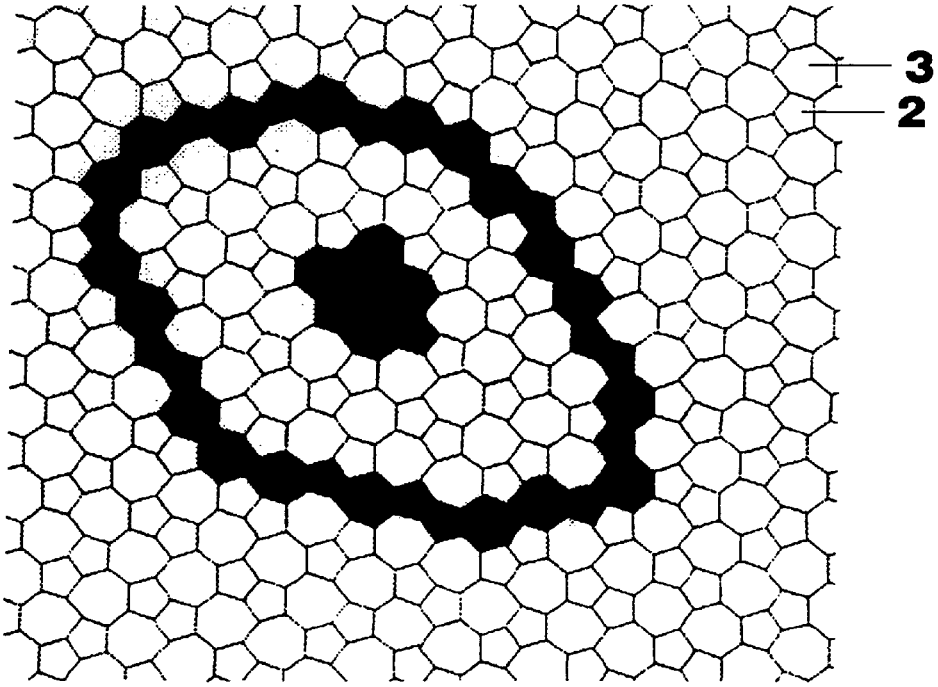
FIG. 10 shows the tessellation of FIG. 5 including a mosaic forming the image of an eye.
Figure 11:
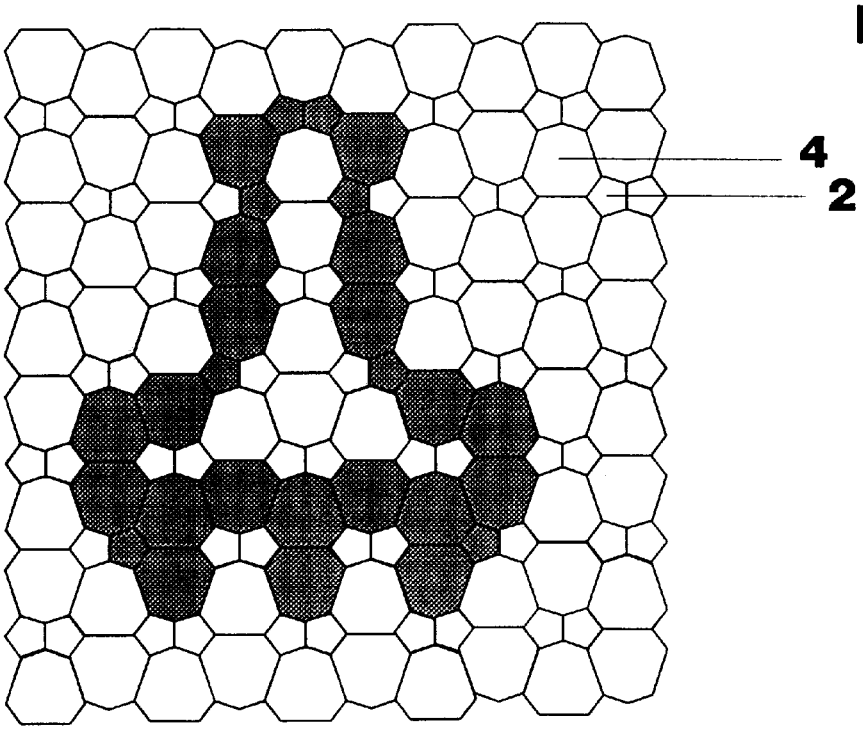
FIG. 11 shows the tessellation of FIG. 7 including a mosaic forming the image of a nose.
Figure 12A:
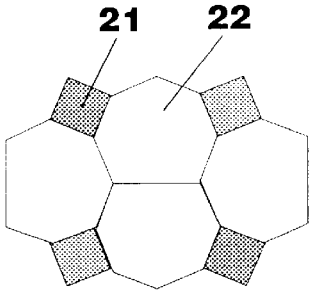
FIGS. 12*a*–12*h* shows various tessellations of square elements and irregular heptagonal elements.
Figure 12B:
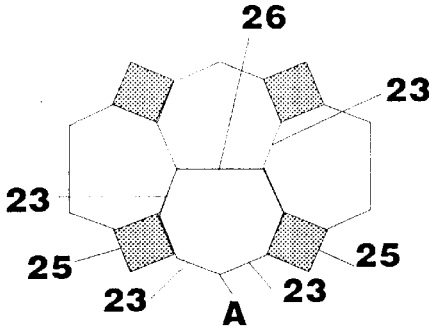
Figure 12C:
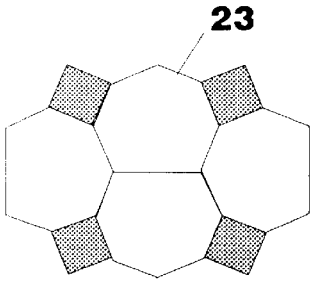
Figure 12D:
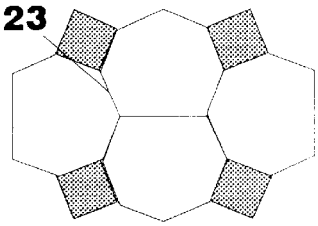
Figure 12E:
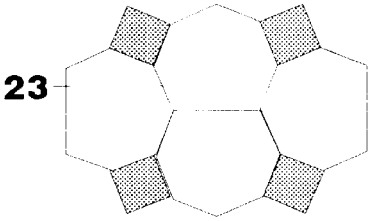
Figure 12F:
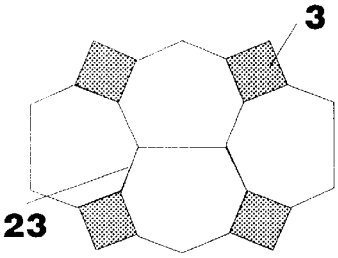
Figure 12G:
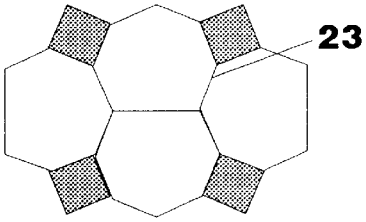
Figure 12H:
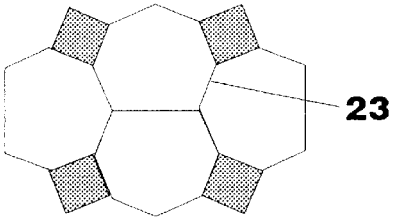

Sometimes, it is desired to incorporate a picture or a pattern in the covering or decoration of a surface. This can be easily achieved using the elements of the present invention. FIG. 10 shows a picture of an eye incorporated in a tessellation of heptagonal elements 3 and pentagonal elements 2. FIG. 11 shows a picture of a nose incorporated in a tessellation of heptagonal elements 4 and pentagonal elements 2. As can be seen from these Figures, the tessellations formed from the appropriate heptagonal and pentagonal elements lend themselves easily to mosaicing. In contrast to tessellations of rectangular elements, curves are effectively formed at junctions between tiles in the tessellations of heptagonal and pentagonal elements, particularly when viewed from a distance. In addition, the apparent randomness of the tessellations and the multi-sided geometry of each element improves the 'flow' of the curves, thus enlivening the resulting picture. The pattern may be a maze for example.

A second embodiment is described with reference to FIGS. 12 to 19.

Referring to FIGS. 12*a*–12*h*, a set of tessellatable elements comprises a set of square elements 21 and a set of heptagonal (seven-sided) elements 22. (The heptagonal element is referred to as seven-sided to avoid confusing it with the heptagonal elements 3, 4, and 5 of the embodiment of FIGS. 1–11.) As described, above with respect to FIGS. 1–11, they may be bricks, paving slabs or other elements for covering surfaces such as roads or pathways for example, or other elements.

A plurality of different seven-sided elements of different relative side lengths may be used and eight examples of these are shown in FIGS. 12*a*–12*h*. In all of these examples, the internal angles remain constant. Five of the internal angles are 135° and the remaining two angles are each of 112.5°. The square, of course, all have the same internal angles of 4×90°. In the first example shown (FIG. 12*a*) and indicated as '100%', the sides of each square are the same length as all but one of the sides of the seven-sided polygon. From this base size, as the length of the sides of the square increases with respect to the base 26 of the seven-sided element, the seven-sided polygon gradually changes shape as shown in FIGS. 12*a*–12*h* which illustrate various examples; 100%, 110%, 115%, 120%, etc. up to 150%. The ultimate shape as the size of the square grows approaches an isosceles triangle. As the squares enlarge, the ratio between the side of the square 25 and the shortest side or sides of the seven-sided element changes from 1:1 (100%) to 1:1.3976 (where the square is 20% enlarged i.e. 120%) to 1:1.6500 (130%) and so on. It is found that a very pleasing proportion is achieved when the ratio is 1:1.414 and very pleasing proportion indeed is seen when the ratio is 1:1.618034 (a ratio generally known as the golden ratio). In each case, the shortest sides of the seven-sided element are the sides 23 adjacent to the base 26 and also the two sides 23 furthest from the base 26 and which meet at the apex A. The square abuts onto the remaining two sides 25 of the seven-sided element which are accordingly of the same length as the sides of the square. As the square increases in relative size so does this size length 25.

In the preferred embodiment of the present invention, the length of a side of the squares 21, 25 may be 100%, 105%, 110%, 115%, 120%, 125%, 130%, 133%, 135%, 140%, 145%, 150%, 155%, 160%, 165%, 170%, 175%, 180%, 185%, 190%, 195% or 200% the length of the shortest side or sides of the seven sided element. In each case, the square abuts onto one, two, three or four respective similar sized edges of adjacent seven-sided elements.

Figure 13:
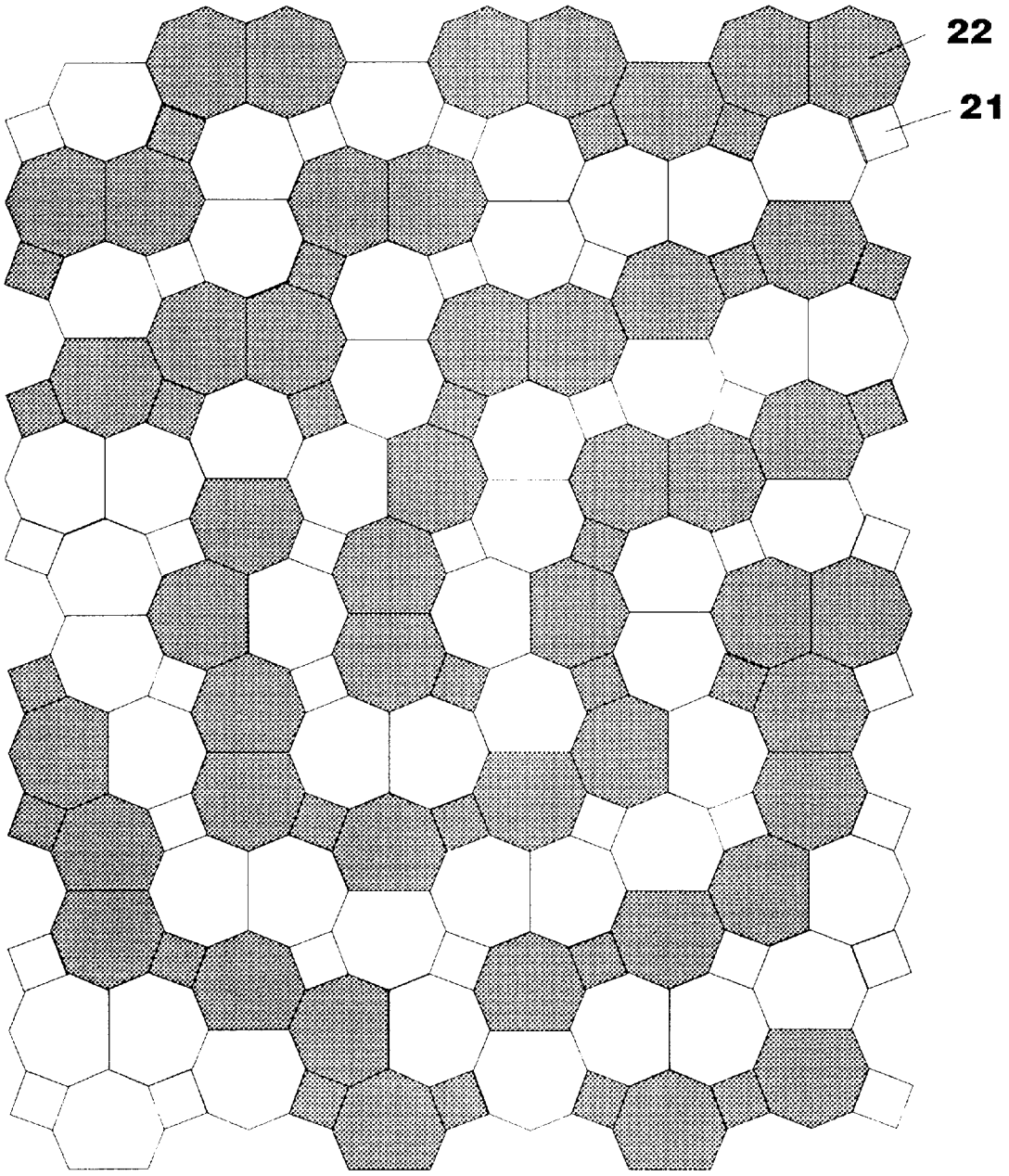
FIG. 13 shows a larger extent of the '100%' tessellation of FIG. 12*a;*
Figure 14:
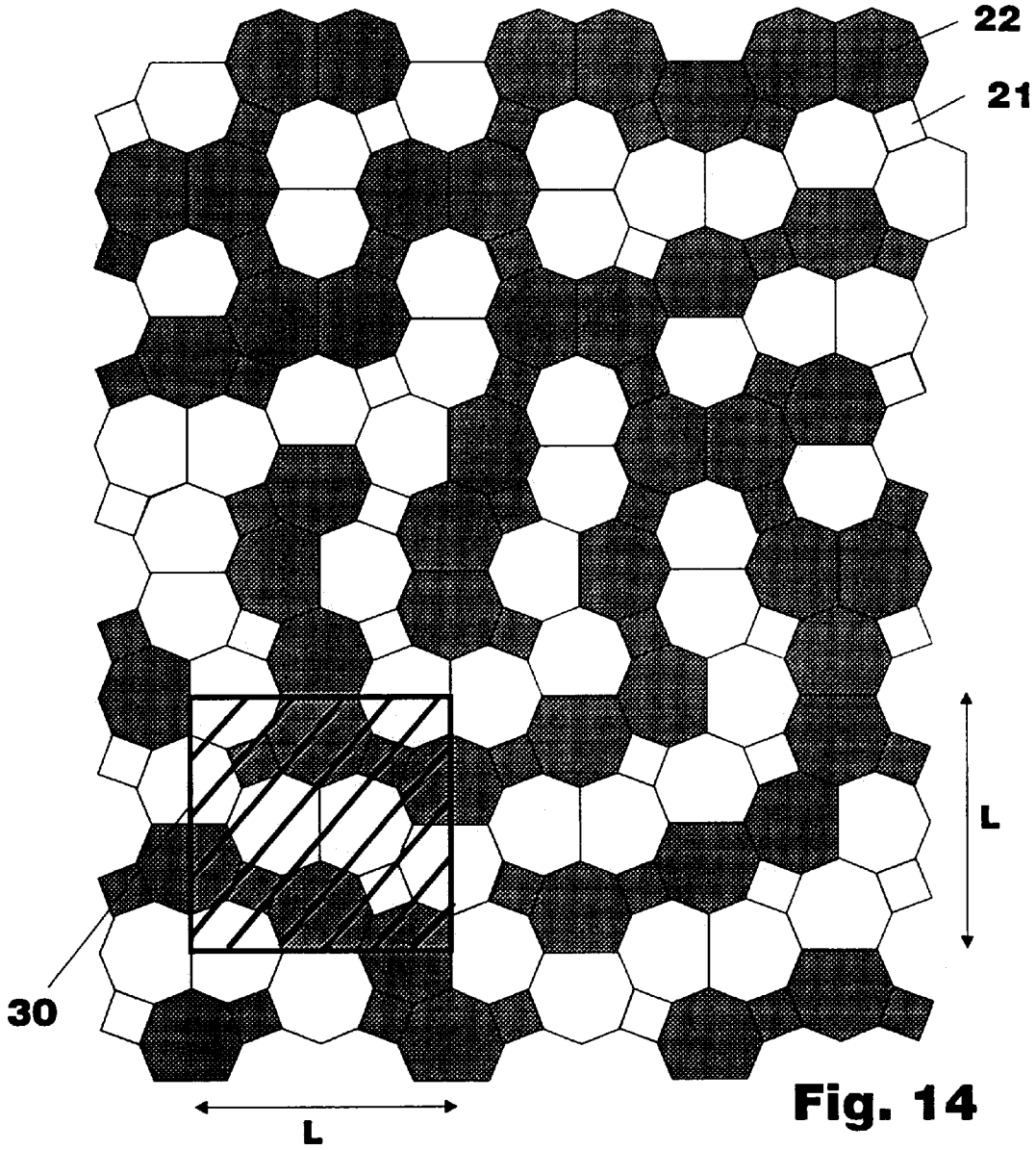
FIG. 14 shows a larger extent of the '120%' tessellation of FIG. 12*d;*

FIG. 13 shows a larger tessellation of the 100% selection where the squares 21 are the same length as the shortest side of the seven-sided element 22. By providing both square and seven-sided elements in each of two different colors (white and gray (shaded) in this example) it is seen how complex patterns can be easily formed by tessellating the elements by abutting them together. There is substantially no wastage and no elements need cutting to provide any desired pattern over a large enough scale. FIG. 14 shows an example where the square is enlarged by 120%. This tessellation includes the part of the seven-sided element on either side of the line of symmetry, an additional (third) element which is notionally formed, for example, by cutting a seven-sided element in half along its line of symmetry (central axis). This element is useful because a tessellation can be defined within a small square unit 30 which repeats itself indefinitely. The small square is defined once by the hatched area 30 and it is seen that it is formed by imagining shapes which are essentially half seven-sided elements. Thus, a tessellation or pattern of any size may be arranged to have straight edges which can be very useful for roads, pathways, etc. or for replacing paving slabs. The length L of each side of square 30, may, for example, be 300 mm, 450 mm, 600 mm, or may be a defined length in imperial units such as 12 inches (305 mm) or 18 inches (457 mm) to concur with standard sizes of paving slabs in a particular country. In this way, a tessellation of a number of elements may be applied to replace an existing paving slab or, a fitter may fit such a pattern easily into a defined area by notionally dividing it into paving slab sized areas.

Figure 15A:
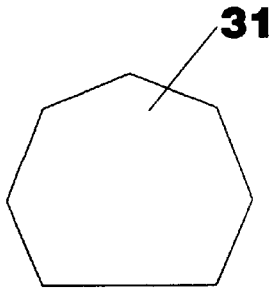
Figure 15B:
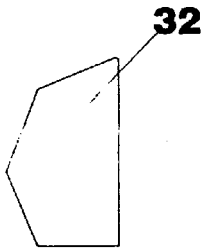
Figure 15C:
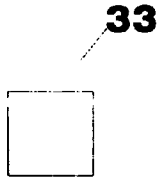

FIGS. 15*a*–15*c* show the three components necessary for forming a tessellation having straight edges. These are a seven-sided element 31 (FIG. 15*a*), a pentagonal element 32 (FIG. 15*b*), notionally or actually formed by dividing a seven-sided element in half along its central axis, and a square element 33 (FIG. 15*c*). Substantially any desired pattern can be formed from just these three building blocks while leaving substantially no wastage and requiring no cutting. The blocks may all be in one color and some of them colored afterwards if necessary or, preferably, each or some of the types of blocks 31, 32 and 33 may be provided in two or more colors or textures. As far as the manufacture of the elements, slabs or whatever is concerned, they need only make three different shaped elements. This is highly economical for manufacture.

Figure 16:
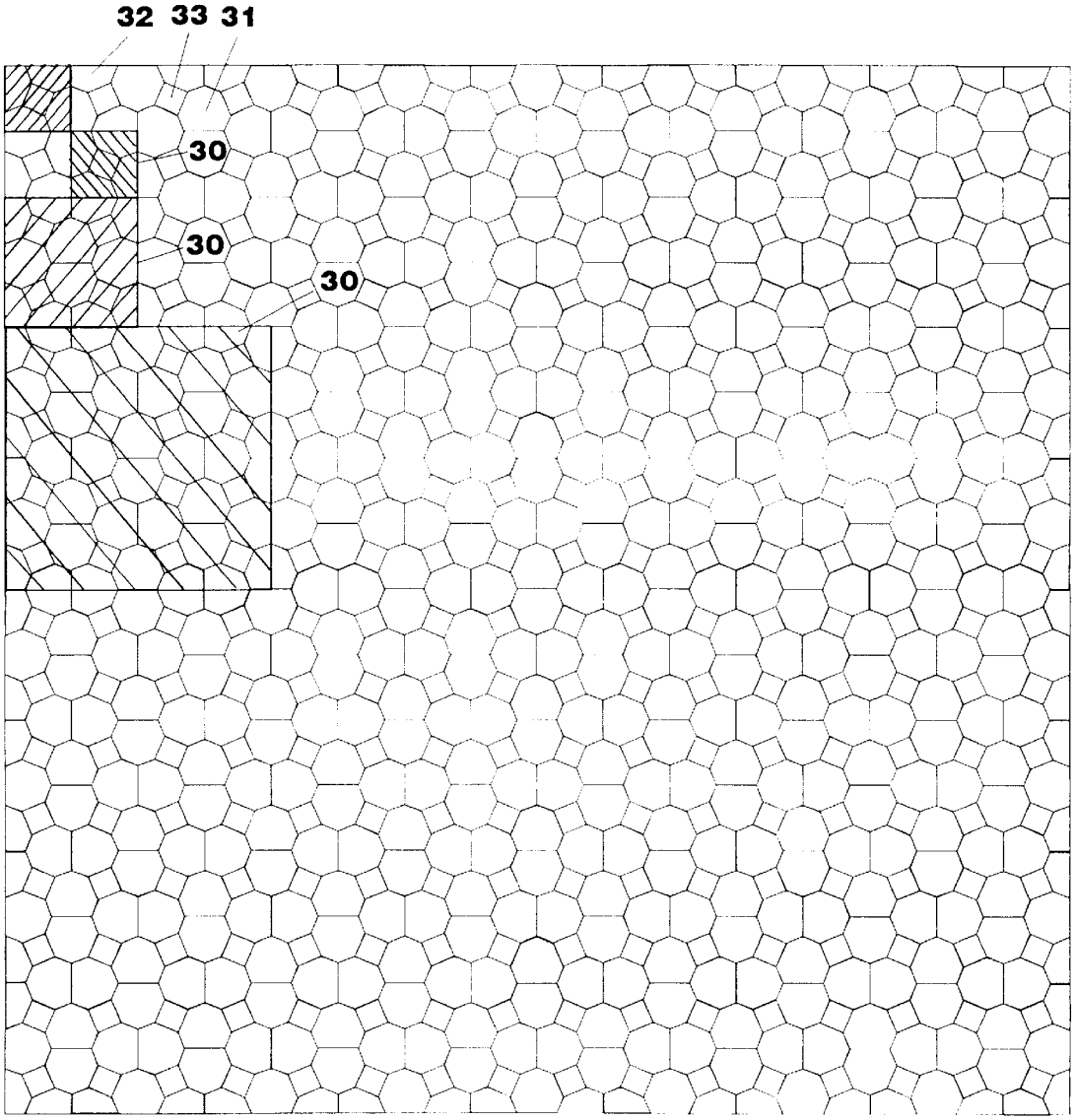
FIG. 16 shows a square tessellation using the 100% tessellation of FIG. 12*a* made from the set of elements depicted in FIGS. 15*a*–15*c;*

FIG. 16 shows a tessellation formed by the elements 31, 32 and 33. The dotted and shaded areas illustrate various size squares which sets of the elements 31, 32 and 33 can form, where the larger squares are multiple of the smaller ones.

EXAMPLE

A three meter square tessellation including the image of a reptile maze shown in FIG. 17 was formed using square paving elements 34, seven-sided paving elements 35, and pentagonal paving elements 36 (half seven-sided polygonal elements) shown in FIGS. 18*a*–18*c*, having the dimensions and in the numbers given below.

TABLE

| Polygonal Paving Element | Side Dimensions & Angles (Clockwise) | | | Number of Each |
|---|---|---|---|---|
| Square | 80 | mm | 90° | 225 |
| Seven-sided | 117.16 | mm; | 112.5° | 418 |
| | 51.67 | mm | 135° | |
| | 80 | mm | 135° | |
| | 51.67 | mm | 135° | |
| | 51.67 | mm | 135° | |
| | 80 | mm | 135° | |
| | 51.67 | mm | 112.5° | |
| Pentagonal | 58.58 | mm | 112.5° | 64* |
| (Half Seven-sided) | 51.67 | | 135° | |
| | 80 | mm | 135° | |
| | 51.67 | mm | 67.5° | |
| | 141.41 | mm | 90° | |

*Four of the 64 half seven-sided polygonal elements were further cut to fit as the four corners of the tessellation. More than 64 of the five sided elements (and less of the seven-sided elements) may be used for artistic effect, e.g., for the reptile's eyes or for long thin terracing.

Figure 17:
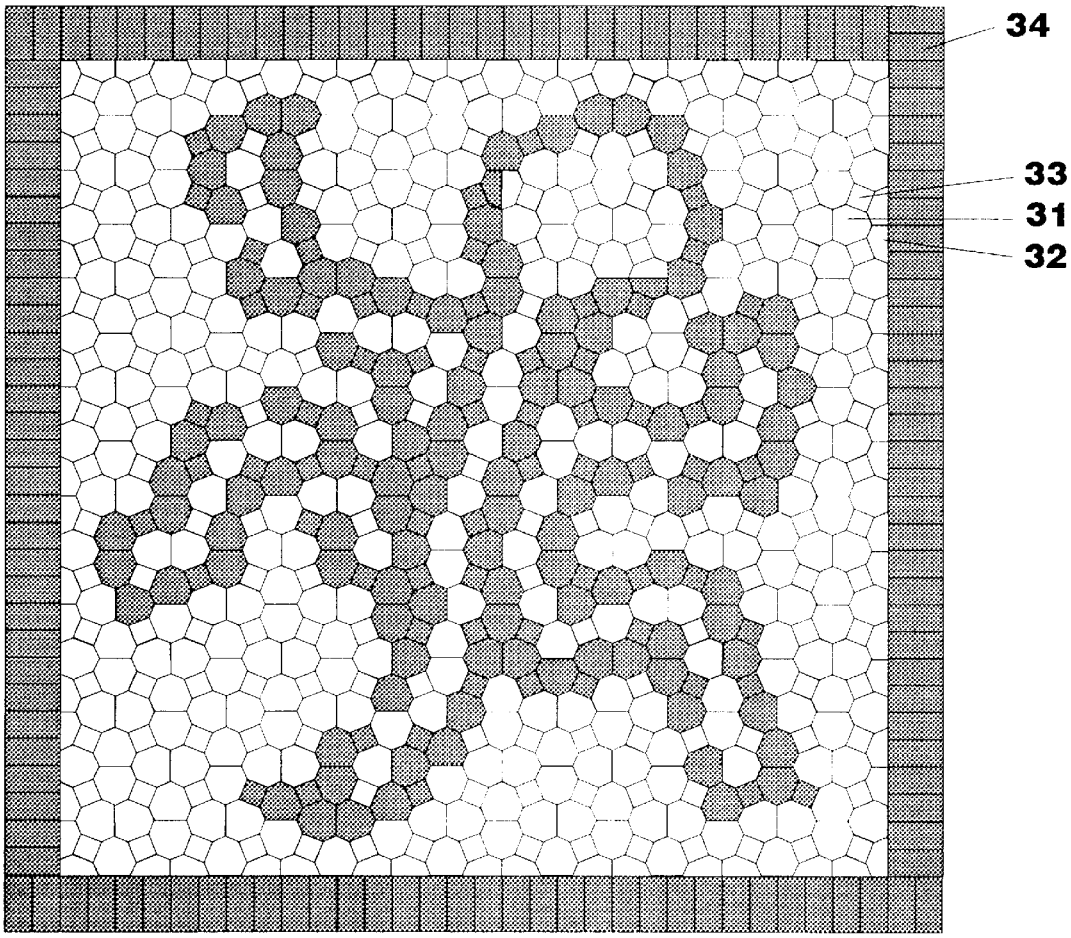
FIG. 17 shows a reptile mosaic made from the tessellation of FIG. 16 using the set shown in FIGS. 18*a*–18*c*, of different colors and regular paving bricks as the border.
Figure 18A:
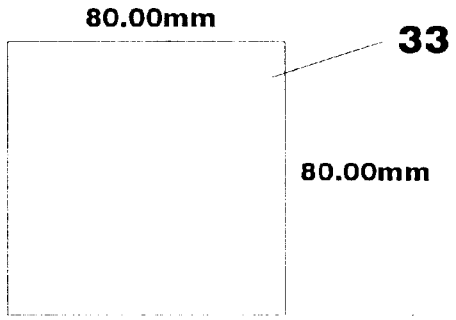
FIG. 18*a*–18*c* show the set of tessellatable elements used to form the mosaic shown in FIG. 17.
Figure 18B:
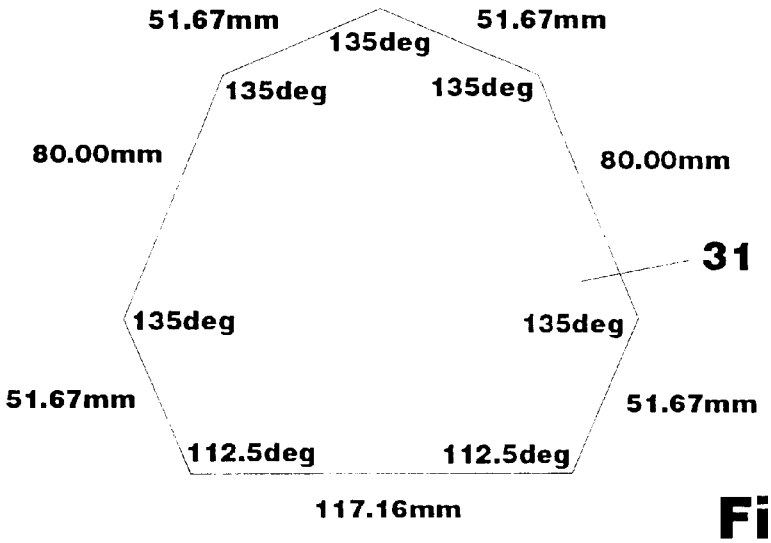
Figure 18C:
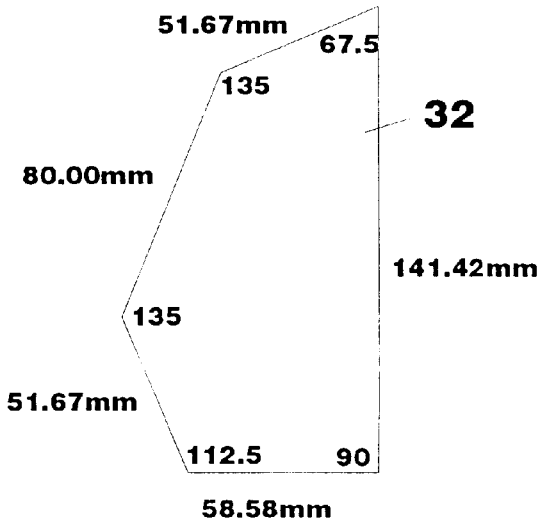

FIG. 17 shows the tessellation with a border and shading to portray the image of a reptile maze based on a reptile design of M. C. Escher, a famous Dutch tessellation designer of the early-mid 20th century. The border in FIG. 17 was formed by 128 standard paving bricks 34 each 100 mm×200 mm. The same tessellation is depicted in FIG. 16 without a border and without shading which would have indicated color and contrasted the image of the reptile maze. The reptile maze tessellation depicted in FIG. 17 was formed from 225 square units each 200 mm square, two of which are shown bounded in FIG. 16 by broken lines and cross-hatched.

Figure 19:
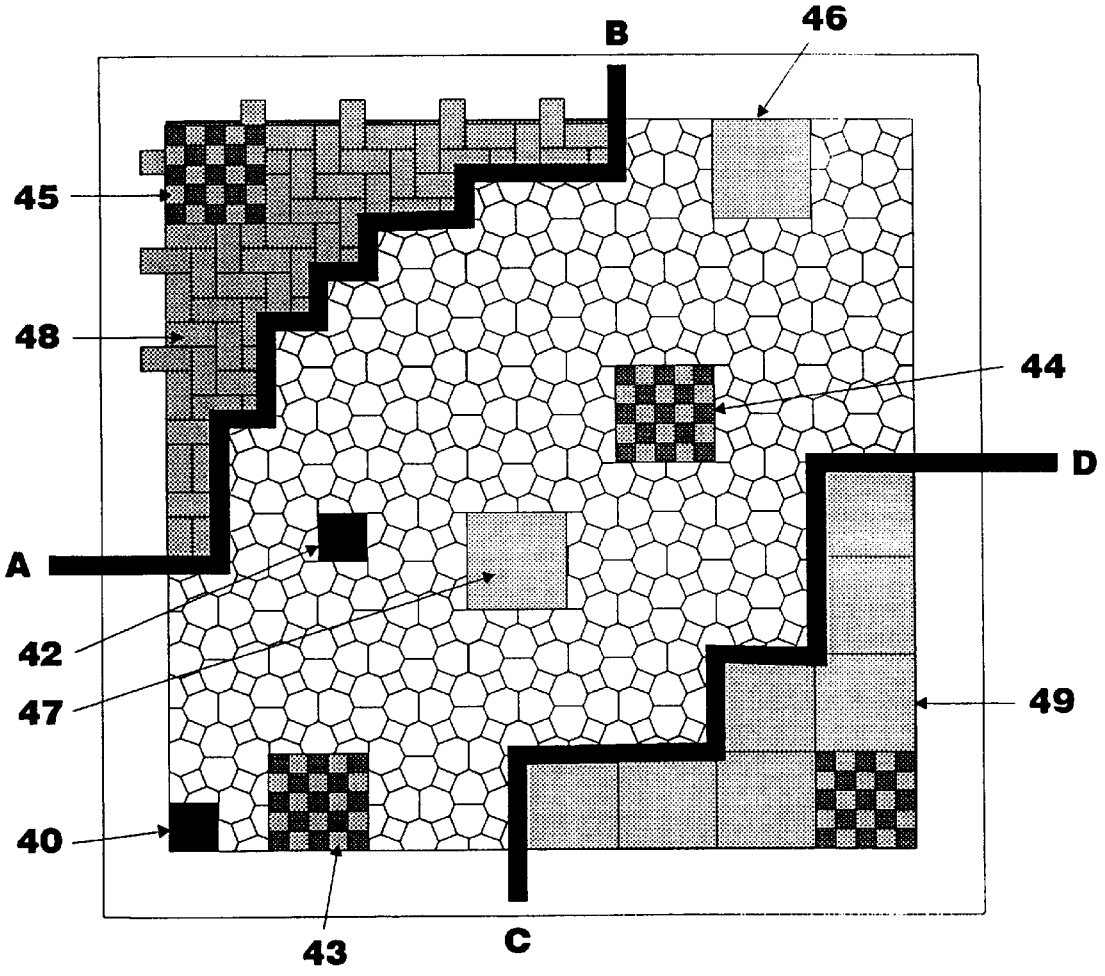
FIG. 19 shows a tessellation of the heptagonal and square elements of FIGS. 15*a*–15*c* with various standard elements.

FIG. 19 shows the versatility of the square/heptagonal system of FIGS. 12–18, which can form 8 inch size squares, or multiples thereof. This is significant because one standard paving brick is 8"×4". Thus, two 8"×4" paving bricks, laid to form an 8 inch square, can be laid on the edge of the tessellation (at 40), or anywhere within the body of the tessellation (at 42). This is also significant because 3.2 inch square tessellatable elements may be laid to form a 16 inch square, on the edge of the tessellation (at 43) or anywhere within the body of the tessellation (at 44). These 16 inch square areas can be used to form a checkered pattern 45, or indeed any other pattern involving 25 small squares.

The square/heptagonal system of FIGS. 12–19 can also form 16 inch squares or multiples thereof. This is significant because the standard concrete paving slab is 16 inches square. Thus, one 16 inch square concrete paving slab can be laid on the edge of the tessellation (at 46) or anywhere within the body of the tessellation (at 47). A 16 inch square formed by 25 of the 3.2 inch square elements can displace a 16 inch square paving slab at the edge or anywhere within the tessellation, and vice versa.

The square/heptagonal system of FIGS. 12–19 can be used to pave curved or irregular paths, driveways and terraces. For example, lines A-B and C-D in FIG. 19 might be the edges of a terrace or driveway, which is broadly curved rather than straight-edged or strictly rectangular. Also, it might be desirable for vehicular traffic to run on one paving pattern, while pedestrians walk on another. Lines A-B and C-D show the boundary between different paving patterns. Adjoining the square/heptagonal tessellation shown in FIG. 19 beyond line A-B, at 48 is an 8"×4" paving block laid in a rectangular herringbone pattern. Also adjoining the square/heptagonal tessellation beyond line C-D, at 49 are 16 inch square concrete paving slabs laid in a rectangular square pattern.

The square/heptagonal system shown in FIGS. 12–19 may be formed with terraced straight edges, as illustrated in FIG. 19. Thus, the tessellation may abut a series of straight edges at right angles to each other, as represented by lines A-B and C-D.

The tessellatable elements shown in FIG. 19 (and similarly in FIGS. 12–18) may be sized in English units, as above, or metric units, based on 200×100 mm paving bricks, 400 mm square paving slabs and 80 mm small square blocks. The relative sizes of the elements may be scaled up or down. For example, if 8.5"×4.25" bricks were being supplied, then the tessellatable elements herein would be scaled up accordingly.

The fact that the set of pentagonal elements 2 and heptagonal elements 3, 4, and 5, and the set of square elements 21 and heptagonal elements 22, 23 can, in equal proportions, form a plane tessellation is significant for the following reasons. Firstly, various, useful tessellations are possible since there are a limited number of sides to each element. Secondly, since one pentagonal or square element is normally used for each heptagonal element used, the calculation of quantities of elements, areas to be covered, and costs involved, are simplified. Further, as only two elements shapes are needed to create a plane tessellation, a set of eight colors, for example, can be supplied with only sixteen lines of stock. Moreover, this entails just two element mold shapes for processes including injection molding, clay brick extrusion, concrete casting, die-cutting of printed material/carpet tiles etc. To provide a second series of elements, only a third element is required since the regular pentagonal elements of the first series can be utilized. Thus, a set of eight colors may be supplied with only twenty-four lines of stock to provide two different tessellation systems.

Preferably, the paving or building stones, blocks, bricks or tiles used in the present invention are similar in size and weight to conventional ones. The paving stones may have, for example, a surface area of between 130 $cm^2$ and 260 $cm^2$. If the elements used to form the tessellations are too large; they are too heavy to work with; the surface they cover or decorate does not have much 'give', resulting in cracking or breaking of the elements; and the 'flow' of the curves in the resulting tessellation is poor unless viewed from a great distance.

These tessellatable paving elements provided by the invention are suitable to be laid to form tessellations in indoor or outdoor locations (i.e. in pedestrian malls, public parks, zoos, airports, bus stations, schools, libraries, etc.). They may be used for covering or decorating surfaces. They may be made of clay, concrete, stone, marble and other materials depending on the application. The multi-sided geometry of the elements forming the tessellations provide an interlocking effect such that it is easy for the tessellations to be assembled uniformly to form unitary structures. This is because the many edges of each element abut against the adjacent edges of neighboring elements. Thus, as a tessellation is formed, it is simple to position an element accurately therein.

When assembling a floor, such as of a pedestrian walk, the paving elements are laid usually from one straight edge, in a repeated pattern to form a tessellation, as shown in the drawings. The paving stones are provided with nibs extending vertically along their vertical sides to correctly space and align one paving stone with respect to another. Sand is used to fill the spaces between each paving stone and is subsequently compacted to position the paving stones firmly.

Since the heptagonal elements 3, 4, 5 and 22 are each provided with an obvious leading vertex, it is easy for a manual worker to lay each paving stone in its correct orientation. A skilled worker can therefore assemble the floor to form a desired tessellation with ease.

The dimensions of the elements used are dependent on the required strength and 'give' of any particular surface. For example, thicker paving elements are required for road surfaces than for walkways.

In another example, the elements are tiles. The tiles may be of concrete, clay, plastics, wood, cork or other materials and may be for floor or wall use. For example, the tiles may be injection-molded interlocking plastic tiles, or may be wall-mountable ceramic or mosaic tiles. The tiles may also be of linoleum or rubber matting.

When cladding a wall, such as an interior wall of a building, the elements may be laid in a repeated pattern to form a tessellation, for example as shown in FIGS. 5, 7 and 9.

The elements used may be contrastly colored in order to create the desired image within the tessellation.

To edge the tessellations used as surface coverings or decorations, particularly when interfacing a tessellation with an area paved with rectangular elements, either specifically-shaped edging elements may be provided, or the heptagonal and/or pentagonal elements may be cut to the shape required.

There may alternatively be elements used for floor or wall coverings, or decorations or coverings for other objects, or elements for use in games, maze games, puzzles, jigsaw puzzles or for any other application where it is necessary or desirable to use a plurality of elements which are generally tessellatable to provide a pattern or covering.

The elements of the present invention are also suitable as printed playing cards or game pieces, such as those made of plastic, wood, card, or ceramics. The tessellations of the present invention may also be used to form coverings or decorations such as patterns in children's coloring books, patterns within computer software games or simulations, patterns on fabrics and patterns formed during the playing of games.

The elements described so far all have straight edges. However, the tessellations could also be created with elements whose geometry conforms at their vertices to the dimensions described above, but whose edges are not straight. Preferably, the edges of these elements are shaped so that they have 180 degree rotational symmetry about their mid-point. The edges could be, for example, wavy, zigzagged, jagged or jigsaw-toothed, yet still be able to interlock to form a plane tessellation since the elements are topologically identical to those having straight edges.

However, for some applications such as card or board games, the shape of the elements' edges could be asymmetrical. For example, the edges could have an off-center pattern or a single protrusion or indentation as a key attribute.

An axis of symmetry in both the heptagonal elements 3, 4, and 5 and the pentagonal elements 22 is preferable since in certain mediums, such as paving blocks or tiles, the tile will have only one correct 'way up' due to its top being chamfered. In contrast, some materials may allow both sides of the elements to be the correct 'way up', such that the elements can take full advantage of the 'right-hand' and 'left-hand' band tessellations.

When one of the two elements is asymmetrical, useful plane tessellations can still be created by using solely 'left-hand' or 'right-hand' bands in the tessellation. Such tessellations may have a particular ratio of surface area between the two elements which is particularly pleasing aesthetically and/or which lends itself excellently to the portrayal of a particular pattern or image.

In addition to the advantages and features described above, the invention may provide the following:

- straight edges at right angles
- curved areas: for example, in paving applications, a curve is accommodated with 200 mm steps using 200 mm×100 mm standard paving bricks and edging triangles to lead to the final edging
- the inventive polygonal paving elements may be integrated with 100 mm×200 mm standard paving bricks, which may be used at the edges and within the tessellation entirely surrounded by abutting inventive elements
- paving tessellations may be formed in convenient 6 m×6 m sizes, which allows accurate layout and grid paving in squares or rectangles since adjacent 6 m×6 m squares are compatible
- an 80 mm square paving element allows a 5×5 array (e.g., in a checkerboard) to fill a 400×400 piece paving, surrounding by five sided elements to form straight edges (this adds extra design capability to the standard 200 mm×100 mm paving system)
- five sided elements provide straight edges
- both the square and seven-sided elements are easy to manufacture because they both have opposite parallel sides
- no acute internal angles, only obtuse and right angles, which reduces damage to the elements from chipping
- the square and seven-sided elements are roughly the same size, which provides a consistent and stable paving system
- tessellation designs may be done by computer, which facilitates change, etc.
- highly attractive terrace designs may be formed
- the designs have a seemingly irregular pattern with no right angles and no straight lines, despite being formed with only two shapes
- color enhances the seemingly irregular pattern even more, so that things and creatures may be portrayed (e.g., dragons, oran utangs, butterflies, lizards, reptiles, etc.)

While the invention has been described and illustrated in connection with preferred embodiments, many variations and modifications as will be evident to those skilled in this art may be made without departing from the spirit and scope of the invention. The invention as set forth in the appended claims is thus not to be limited to the precise details of construction set forth above and such variations and modifications are intended to be included within the scope of the invention.

I claim:

1. A set of tessellatable elements for covering or decoration comprising as few as two different tessellatable elements, the two different tessellatable elements consisting of a first polygonal element and a second polygonal element the first polygonal element having a different number of sides from the second polygonal element, at least the first polygonal element having an odd number of sides and no internal angle of 90°.

2. The set of tessellatable elements according to claim 1 wherein the first and second polygonal elements have no acute internal angles.

3. The set of tessellatable elements according to claim 1 wherein at least one of the first and second polygonal elements has equal length sides, equal internal angles, or both.

4. The set of tessellatable elements according to claim 1 wherein at least one of the first and second polygonal elements in the set is a substantially regular polygonal element.

5. The set of tessellatable elements according to claim 4 wherein one of the first and second polygonal elements is a regular pentagonal element and the other is a heptagonal element.

6. The set of tessellatable elements according to claim 5 wherein the heptagonal element is irregular.

7. The set of tessellatable elements according to claim 6 wherein the irregular heptagonal element has a line of symmetry therethrough.

8. The set of tessellatable elements according to claim 7 comprising a third tessellatable element which is that part of the irregular heptagonal element on either side of the line of symmetry.

9. The set of tessellatable elements according to claim 4 wherein one of the first and second polygonal elements is a square and the other is a heptagonal element.

10. The set of tessellatable elements according to claim 9 wherein the heptagonal element is irregular.

11. The set of tessellatable elements according to claim 10 wherein the irregular heptagonal element has a line of symmetry therethrough.

12. The set of tessellatable elements according to claim 11 comprising a third tessellatable element which is that part of the irregular heptagonal element on either side of the line of symmetry.

13. A tessellation of tessellatable elements for covering or decoration comprising the two different tessellatable elements of claim 1.

14. A set of tessellatable elements for covering or decoration comprising the two different tessellatable elements of claim 1.

15. A set of tessellatable elements for covering or decoration comprising as few as two different tessellatable elements, the two different tesselletable elements consisting of a first polygonal element and a second polygonal element, the first polygonal element being heptagonal and the second polygonal element being at least one of a pentagonal element and a square element.

16. The set of tessellatable elements according to claim 15 wherein two adjacent sides of the heptagonal element are contiguous and parallel, thereby forming a six-sided polygon, a first of the adjacent sides having a first length and a second of the adjacent sides having a second length.

17. The set of tessellatable elements according to claim 16 wherein the second length is about 0.6 times as long as the first length.

18. The set of tessellatable elements according to claim 16 wherein the heptagonal element is the six-sided polygon which has three interior angles of about 144°, two interior angles of about 108° and one interior angle of about 72°.

19. The set of tessellatable elements according to claim 15 wherein the heptagonal element is symmetrical about a line of symmetry, and further comprising at least one pentagonal element formed by the part of the seven-sided element lying on either side of the line of symmetry.

20. The set of tessellatable elements according to claim 19 wherein the set includes the square element, and wherein the heptagonal element has an apex and a side remote from the apex, the line of symmetry being between the apex and a point mid-way along said side, the ratio between the side length of the square element and the shortest side or sides of the heptagonal element being 1:1, 1:1.65, 1:1.414 or 1:1.618034.

21. The set of tessellatable elements according to claim 19 which has straight edges.

22. The set of tessellatable elements according to claim 15 wherein the heptagonal element has an apex and a side remote from the apex, the line of symmetry being between the apex and a point mid-way along said side, the length of each of the sides on one side of the line of symmetry except the remote side being equal to the length of the corresponding side on the other side of the line of symmetry.

23. The set of tessellatable elements according to claim 15 wherein the set includes the square element, and wherein the heptagonal element has an apex and a side remote from the apex, the line of symmetry being between the apex and a point mid-way along said side, the side length of the square element relative to the shortest side or sides of the heptagonal element being between 100% and 200% of the heptagonal element.

24. The set of tessellatable elements according to claim 15 wherein the tessellatable elements constitute at least one of bricks, tiles, paving-slabs, playing cards, game pieces and computer-generated images.

25. The set of tessellatable elements according to claim 15 wherein the edges of the elements substantially abut.

26. The set of tessellatable elements according to claim 15, wherein the pentagonal element does not include any internal angle of 90°.

27. The set of tessellatable elements according to claim 15 wherein the first polygonal element is an irregular heptagonal element and the second polygonal element is a substantially regular pentagonal element.

28. The set of tessellatable elements according to claim 27 comprising a plurality of units for building the rows of a tessellation, each unit comprising two heptagonal and two pentagonal elements which are arranged to form the unit.

29. The set of tessellatable elements according to claim 27 wherein the heptagonal element has a long diagonal which is the longest distance between non-adjacent vertices thereof and which is parallel to the direction of the row of the tessellation, and which is also parallel to one side of the pentagonal element tessellated therewith; and wherein the ratio of the length of the side of the pentagonal element to the length of the long diagonal is in the range from 1:1.5 to 1:6.0.

30. The set of tessellatable elements according to claim 27 wherein the heptagonal element has one interior angle of about 108°, two interior angles of about 144°, two interior angles of about 124°, and two interior angles of about 128°.

31. The set of tessellatable elements according to claim 30 wherein the two interior angles of about 124° are 123.826° and the two interior angles of about 128° are 128.174°.

32. The set of tessellatable elements according to claim 27 wherein the heptagonal element has one interior angle of about 144° and six interior angles of about 126°.

33. The set of tessellatable elements according to claim 27 wherein at least one edge of the heptagonal element and at least one edge of the pentagonal element are correspondingly shaped such that they are tessellatable while not being straight.

34. The set of tessellatable elements according to claim 33 wherein the non-straight edges of the elements have 180° rotational symmetry about their mid-point.

35. The set of tessellatable elements according to claim 27 wherein the heptagonal element has four sides of a first length and three sides of a second length.

36. The set of tessellatable elements according to claim 35 wherein the first length and the second length are equal.

37. The set of tessellatable elements according to claim 35 wherein the first length is larger than the second length.

38. The set of tessellatable elements according to claim 35 wherein the first length is shorter than the second length.

39. The set of tessellatable elements according to claim 38 wherein the second length is about 1.9 times as long as the first length.

40. The set of tessellatable elements according to claim 35 wherein the sides of first length are equal in length to the sides of the pentagonal element.

41. A set of tessellatable elements comprising as few as three different tessellatable elements, the three different tessellatable elements consisting of a regular polygon, an irregular polygon having a line of symmetry, and a polygon which is that part of the irregular polygon on either side of the line of symmetry which may be used at an edge of a tessellation formed with the regular polygon and the irregular polygon to provide thereat a straight edge.

42. A set of tessellatable elements for covering or decoration comprising the three different tessellatable elements of claim 41.

* * * * *